US005381155A

United States Patent [19]

Gerber

[11] Patent Number: 5,381,155

[45] Date of Patent: Jan. 10, 1995

[54] VEHICLE SPEEDING DETECTION AND IDENTIFICATION

[76] Inventor: Eliot S. Gerber, 9 Frog Rock Rd., Armonk, N.Y. 10504

[21] Appl. No.: 257,267

[22] Filed: Jun. 9, 1994

Related U.S. Application Data

[63] Continuation-in-part of Ser. No. 164,010, Dec. 8, 1993, abandoned.

[51] Int. Cl.[6] ..... G08G 1/01

[52] U.S. Cl. ..... 342/104; 342/66; 340/936

[58] Field of Search ..... 342/104, 66, 61; 340/936, 937, 933, 928, 941

[56] References Cited

U.S. PATENT DOCUMENTS

| | | | |
|---|---|---|---|
| 4,866,438 | 9/1989 | Knisch | 340/936 |
| 5,204,675 | 4/1993 | Sekine | 340/933 |
| 5,231,393 | 7/1993 | Strickland | 340/936 |

*Primary Examiner*—Mark Hellner
*Attorney, Agent, or Firm*—Eliot S. Gerber

[57] ABSTRACT

A method of traffic control is disclosed which includes the steps of measuring the speed of a vehicle, automatically reading the license plate of the vehicle, automatically, in a computer system, matching the license plate number to information about the owner of the vehicle, and displaying the name of the owner of the vehicle.

26 Claims, 4 Drawing Sheets

VEHICLE SPEEDING DETECTION AND IDENTIFICATION

RELATED APPLICATION

This application is a continuation-in-part application partly based upon application Ser. No. 08/164,010, filed Dec. 8, 1992 now abandoned.

FIELD OF THE INVENTION

The present invention relates to vehicle traffic control and traffic surveillance and more specifically to the detection and identification of vehicles whose speed exceeds the legal limit.

BACKGROUND OF THE INVENTION

At the present time the enforcement of vehicle speed limits is based primarily on the intervention of police officers. For example, a police officer in a car will observe the speed of a suspected speeding car by following the speeding car and monitoring the officer's speedometer. Alternatively, a police officer on the side of the road, or in his car, will detect and record the speed of a moving vehicle using radar, such as Doppler radar, or a laser beam, or sensing coils on the roadway, as in U.S. Pat. No. 4,234,923.

The control and reduction of speed limit violations is both a safety and traffic issue. It is believed that the number of highway accidents may be reduced if motorists obey the speed limits, or at least keep their speeds to no more than 10 miles above the limits. If more drivers drove at safe and legal speeds, the number of motor vehicle collisions, and associated injuries and fatalities, would be reduced. If the number of highway accidents may be reduced, the savings in medical expenses and car repair expenses would be enormous. In addition, traffic accidents are a major cause of traffic congestion, since blocking one of three lanes of a highway due to a traffic accidents may reduce the highway capacity by 50 percent.

In addition, it has been suggested, at least in the patent literature, that vehicle speeds may be automatically monitored and a photograph taken of those vehicles which exceed the speed limit, as in U.S. Pat. Nos. 4,866,438 and 5,066,950. Those systems require a matching of the photograph of the license plate number with a list of license plate numbers and mailing the traffic violation ticket to the owner of the vehicle. That system is not legally acceptable in many states, since there is no human witness of the traffic violation and the owner of the vehicle may not be the one driving at the time of the speeding violation.

In U.S. Pat. No. 5,231,393 entitled "Mobile Speed Awareness Device", the speed of a vehicle is detected by a radar gun. The vehicle speed is displayed on a lighted number display board mounted on a trailer.

In U.S. Pat. No. 5,204,675 an automatic toll collecting system obtains vehicle identification from a vehicle number plate and calculates the toll based on the number plate.

OBJECTIVES OF THE INVENTION

It is an objective of the present invention to provide a traffic control system and method which will automatically, without human intervention, detect and identify those vehicles which exceed a selected speed limit and provide a visual warning to the driver of his speed, license plate number and vehicle ownership and an implication or warning that these are being recorded.

It is a further objective of the present invention to broadcast relevant information, by voice or print-out or both, concerning illegally speeding vehicles to police officers positioned in a location to issue traffic violation tickets (citations) to the drivers of such vehicles, the relevant information including the license plate number, the vehicle model, make and year, and its registered owner.

It is a further objective of the present invention to record the visual warning given to the speeding vehicles and to optionally photograph the speeding vehicle and driver in order to prove that the warning was given.

It is a further objective of the present invention to detect stolen cars, cars which lack legally required insurance coverage, and cars driven by unlicensed drivers ("scofflaws") and to automatically broadcast to police officers in the vicinity a description of the car and its license plate number so that it may be detained.

SUMMARY OF THE INVENTION

In accordance with the present invention there is provided a system and method to provide a visual warning to illegally speeding vehicles.

The system consists of four basic elements, namely, an automatic vehicle speed detector, a license plate number reader which produces a digital signal indicating the license plate number, a computer databank and access system which compares the license number of the speeding vehicle with the databank of registered vehicles and produces its identification including the registered owner of the speeding vehicle in less than one second and a large alpha-numeric variable message sign proximate the roadway to display the warning. The warning will specifically identify the vehicle, for example, a warning may be "Mr. Jones, VH124, you are speeding 86 MPH". That warning, along with additional information retrieved from the databank, such as the vehicle model and year, will be recorded and will also be broadcast, by voice or print-out or both, to police officers ahead of the vehicle who may issue a traffic violation summons to the vehicle driver based on their own observation, using radar or other speed measurements, of the speeding vehicle. Optionally, a camera may record the speeding vehicle and its driver, so that the warning may be proven in court or so that a warning letter may be sent to the vehicle owner.

In addition, and optionally, the system may be used to detect "wanted cars", namely,stolen cars or cars having an excessive number of traffic violations ("scofflaws") or cars likely to be illegally driven by drivers with suspended licenses or cars which do not have the legally required insurance coverage. In this alternative, all cars, whether or not speeding, passing the license plate reader will have their plate numbers read and rapidly compared to a database list of stolen, uninsured and scofflaw cars. If a car is on that list, the warning sign is not operated and a police officer ahead of the car is notified as to the car's identify (model, year, etc.) and the reason it is on the "wanted" list.

In an alternative mode of operation, the "wanted car" database and/or the entire license plate database is located at a traffic management center or at police headquarters. Such a system is in accordance with the recent technological advances in traffic control and management (Intelligent Vehicle—Highway Systems—IVHS).

These advances have focused on incorporating transmitters and sensors proximate the highways and having information transmitted to traffic management centers or to police headquarters. At these locations the information is deciphered and monitored for speeding, recently stolen cars, "scofflaw" cars and cars likely to be illegally driven by drivers with suspended licenses. The transmitters are electrically connected to the output of the camera systems, but the memory storage devices which store the "wanted cars" database would be located at the traffic management centers or at police headquarters. The storage devices could preferably be incorporated into a mainframe computer. This method of practicing the invention, i.e., each individual system is connected via wireless communications means or by phone lines to a main database, is in conformance with the advanced traffic management systems (ATMS).

BRIEF DESCRIPTION OF THE DRAWINGS

Other objectives of the present invention will be apparent from the following detailed description of the invention, taken in conjunction with the accompanying drawings.

In the drawings.

DETAILED DESCRIPTION

Figure 1:
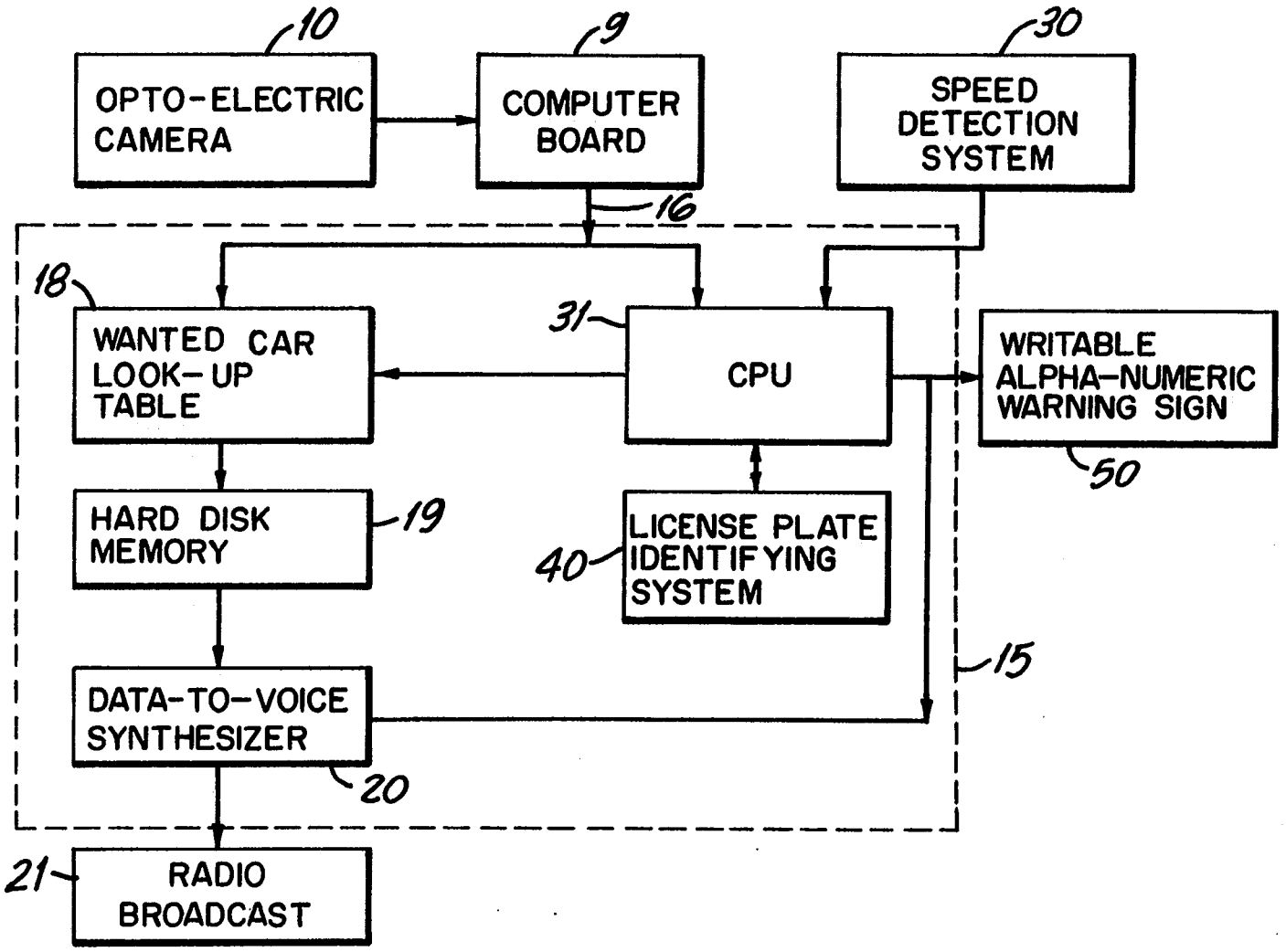
FIG. 1 is a block schematic drawing of the system of the present invention.
Figure 2A:
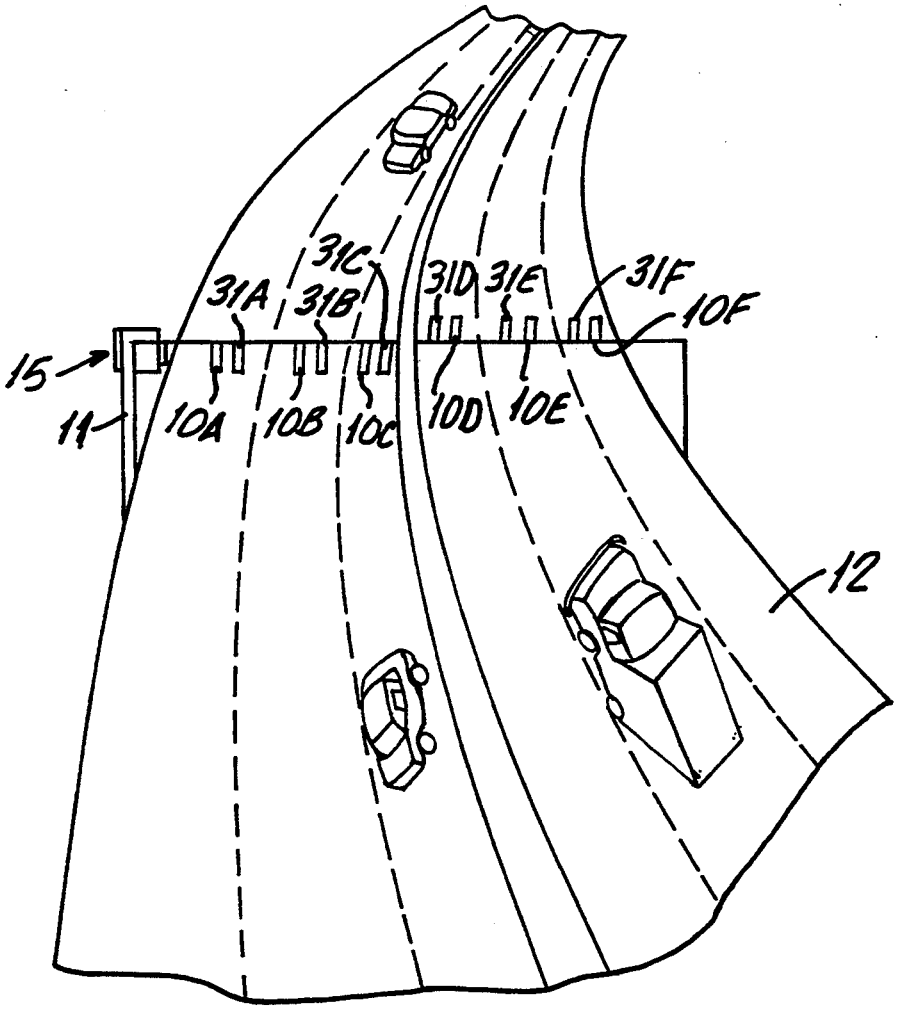
FIGS. 2A and 2B are perspective views of mounting systems for the license plate reader and camera.

As shown in FIGS. 1 and 2, the system of the present invention includes an optoelectric camera 10 to read the alphanumerics on vehicle license plates. The camera 10 is mounted on a support structure 11 above the roadway 12, although alternatively it may be mounted on a post on the side of the roadway 12. In FIG. 2 six cameras 10A, 10B, 10C, 10D, 10E and 10F are shown, which would be used on six lanes of a highway. On a three-lane unidirectional highway, three cameras would preferably be used, with each camera directed to monitor vehicle traffic in each lane. Accordingly, two cameras would be used on a two-lane bi-directional highway.

Figure 3A:
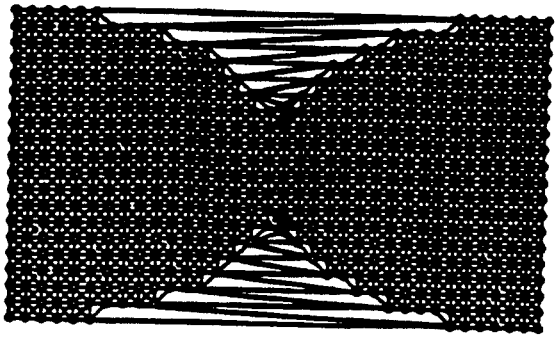
FIGS. 3A and 3B illustrate the neighbor relationships of the forward (FIG. 3A) and inverse (FIG. 3B) logmaps in which each pixel is represented by a circle whose size is proportional to the size of the corresponding pixel and with a line drawn between each pixel and its neighbors.
Figure 3B:
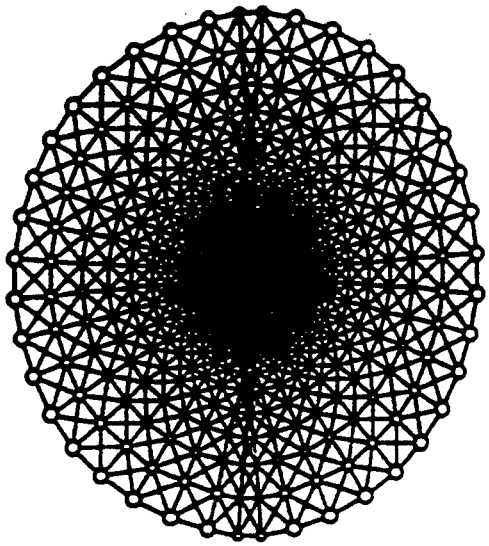
Figure 4:
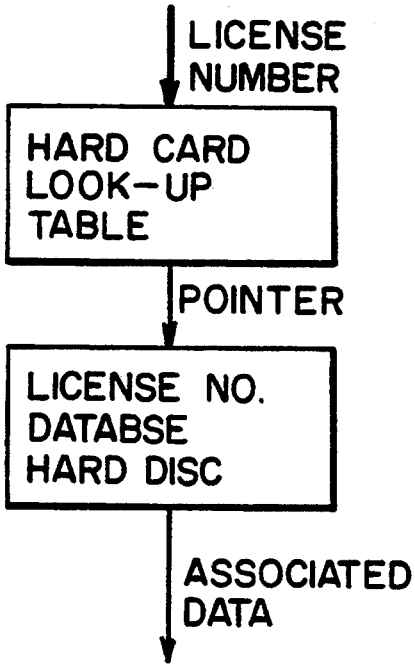
FIG. 4 is a block diagram of the computer databank access system.
Figure 5:
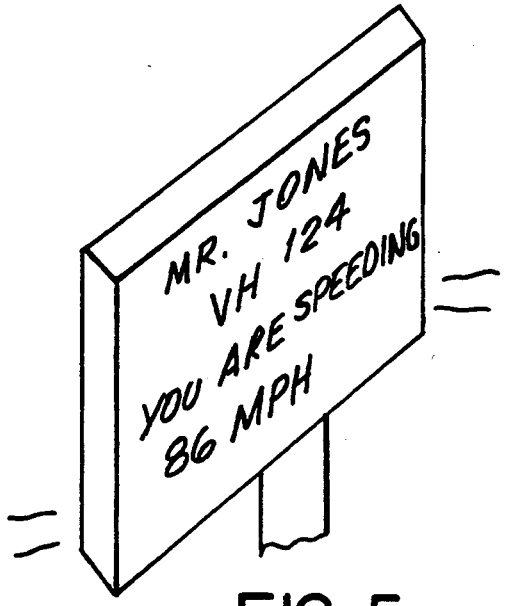
FIG. 5 is a perspective view of the roadside alphanumeric variable message warning sign with a typical warning thereon.

The camera converts the license plate numbers into a conventional ASCII digital code. A suitable camera is available from Vision Applications Inc. (Allston, Mass.). That camera is utilized in U.S. Pat. Nos. 5,175,617 and 5,204,573. It produces a logmap image from a space-variant sensor, as shown in FIGS. 3A and 3B, preferably a CCD image sensor (Charge Coupled Device) having 192×165 pixels (31,680 total) with a lens assembly of under 0.5 ounce, the image sensor being mounted on a spherical pointer motor.

Preferably the camera operates to read the license plates of all the vehicles passing within its range and not only "speeding vehicles" i.e., those vehicles whose speed exceeds a predetermined limit, for example, 65 miles per hour (MPH) in a 55 MPH legal speed zone. The camera is electrically connected to a specialized computer board 9 which converts the alpha-numerics of the license plates of vehicles to a digital ASCII code which is transmitted as data stream 16 to computer system 15. That conversion may use algorithms and other techniques used in character recognition systems. The license plate characters, in one state, would be of only a few fonts, making their conversion to digital signals relatively simple. Preferably the computer system 15 is physically mounted on the same support structure 11 as the camera 10. The computer system 15, with a suitable time-sharing buffer memory, may be used for a plurality of pairs of cameras and speed detectors.

An alternative license plate number reader was announced in April, 1994 and is available from Racal Radio Limited, Reading, Berkshire, England. It reads license plates from a recorded video image (digital image grabber) using pattern recognition techniques and neural networks. The neural networks are trained on a large number of sample characters. That system, called "Talon" (TM), recognizes license plates in about 0.25 seconds: reads plates on cars traveling at high speed; data can be locally stored or transmitted via land-line or radio to a remote site; and reads plates directly from a video image using programmable DSP (Digital Signal Processing) hardware. The system includes a camera, lighting, plate recognition unit (PRU) and keyboard and would cost about 20 thousand dollars. It displays, among other things, a copy of the video image and a rolling log of license plates, the log output being via a standard RS 232 interface.

The data stream 16, of all license plate numbers, is transmitted to the "wanted car" database and compared to the license numbers in that database. Preferably the "wanted car" database consists of a list of recently stolen cars, "scofflaw" cars (cars having numerous unsatisfied traffic violations), cars likely to be illegally driven by drivers with suspended licenses, and cars which do not have the legally required minimum insurance.

As shown in FIG. 1, the "wanted car" database is preferably a look-up table 18 of license plate numbers executed in electrically changeable solid-state memory, for example, a EEPROM (Electrically Erasable Programmable Read Only Memory). That look-up table 18 is changed often, for example, hourly, as cars are reported as stolen. Its list of wanted car license plate numbers is changed, preferably over a telephone line from police headquarters, having a front-end computer which broadcasts revised lists to all the "wanted car" databanks in the system.

The data in look-up table 18 is compared to the license plate numbers of data stream 16 with its list of wanted cars to determine if there is a match, preferably as explained below. The data from the EEPROM look-up table 18 is downloaded into the RAM of the cpu 31 and stored in an 18×48 bit array. The license plate identifying system 40 produces a track and sector pointer to the hard disk memory 19.

In one embodiment, a "hashing algorithm" is employed to generate the pointer which maps the license plate number to a track and sector. A hashing algorithm is a method of quickly retrieving data by assigning each data item a "key" which maps to a physical file location. The key is generated by a modulo division of the license plate number using a prime divisor approximately equal to the total number of storage locations. The modulo quotient (remainder) is the key (see following example).

HASHING EXAMPLE

Assume 10,000 storage locations
License # is 741
741/9998=6 R 4114

Divide 4114 by number of bits per track/sector to determine physical location for data. A sequential search is then performed in the identified disk sector.

B-Tree Format

In an alternative embodiment, the license plate data on hard disk memory 19 is stored in "b-tree format".

A b-tree format consists of several levels of linked pointers which enable the software to locate a data item based upon a small number of lookups. For example, if data for license number 100 is at track 1 sector 2, the lookup would first determine where licenses less than 999 were stored, then where licenses less than 499 were stored, and then where licenses less than 124 were stored. Then the licenses less than 124 would be searched sequentially.

Figure 7:
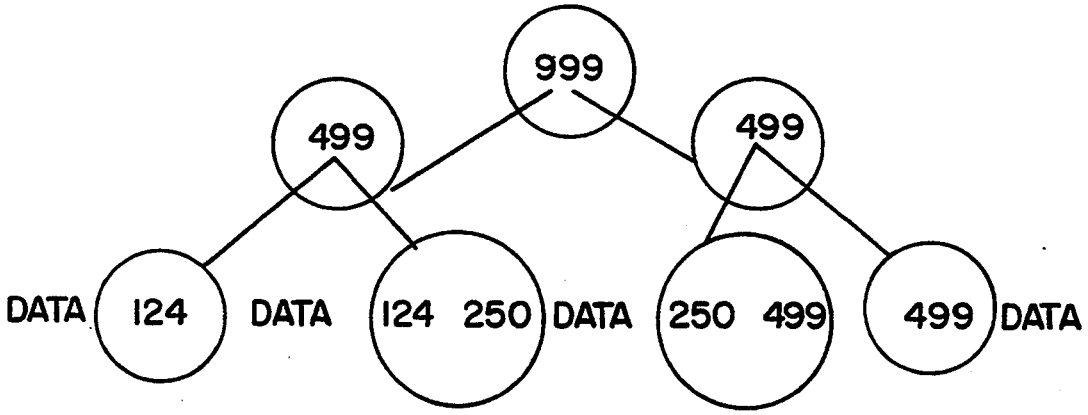
FIG. 7 is an illustration of the b-tree format concept.

FIG. 7 is an illustration of the b-tree format concept.

In another alternative embodiment the license plate numbers are stored according to an indexing scheme which maps particular ranges of license plate numbers to a given track and sector. The hard disk computer memory 19 contains "associated information" (information associated with the license number) for each car such as registered owner, model, make, year, owner, color, and the reason it is on the "wanted" list.

When a match is found, and the associated information (model, make, etc.) retrieved from memory 19, the license plate number and associated information is broadcast by local radio transmitter 21, mounted on support structure 11, to police cars in the area. A suitable broadcast system would entail a two-way digital communication system using microwaves in the 2.5 gigahertz band. The system should be two-way, because the database which stores the "wanted cars" is updated periodically and the system transmits associated information to police cars in the area. In addition, the radio system is also able to relay information to the driver of those cars which have an in-vehicle navigation and communication system. The driver's in-vehicle system can "tell" the driver that he is speeding or that the police have been summoned.

In addition, or alternatively, the information may be transmitted by means of a radio paging network. The police cars would have receivers mounted on their dashboards which would pick up the transmitted information and either display it on a CRT, synthesize the data into voice, or print the data. The information about the "wanted cars" or/and speeding cars may also be displayed on a cathode-ray-tube (CRT) situated on the dashboards of police cars.

Preferably the digital data format information is converted to voice information by a conventional data-to-voice synthesizer 20. Alternatively, or in addition, it may be broadcast as a data stream and converted to a print-out by a data to alpha-numeric printer in the police cars.

The "wanted car" database is optional and the speeding car warning system may be implemented without it. However, it takes advantage of the camera 10 and radio broadcast transmitter 21 of the speed warning system.

Figure 2B:
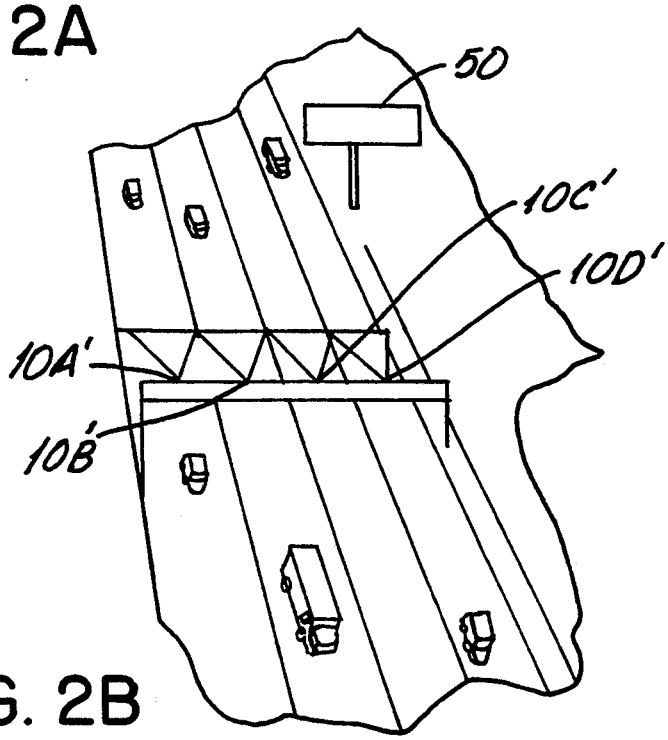

A vehicle automatic speed detection system 30 is connected to the computer system CPU 31 (Central Processing Unit) which times and controls the entire system. The CPU 31 is preferably a microprocessor such as an Intel 486 DX2/50HZ. The speed detection system 30 may be of various conventional types, including Doppler radar (see U.S. Pat. No. 4,866,438), laser beam, RF (Radio Frequency) beams which are detected by coils on the roadway, as in U.S. Pat. No. 4,234,923, and a system using parallel and reflected infrared beams, as in U.S. Pat. No. 5,066,950 and inductive loops of cable installed into sawcuts in the roadway (available from International Road Dynamics, Inc., Saskatoon, SK, Canada). Doppler radar gun devices 31A, 31B, 31C, 31D and 31E are illustrated in FIG. 2, pointed, like cameras 10A, 10B, 10C, 10E and 10F at two lanes of a six-lane roadway. Alternatively, as shown in FIG. 2B, the cameras 10A', 10B', 10C' may be used to detect speeding vehicles. For example, the location of the vehicle's license plate movement is compared over 2–10 frames. The distance of the license plate movement, from frame to frame, is an indication of the speed of the vehicle.

In addition, and optionally, a photograph may be made of the speeding vehicles and their drivers. Such a photograph system is described in U.S. Pat. No. 5,066,950. Since the system of the invention includes an automatic speed detection system 30, the addition of the photograph capability does not add greatly to cost or complexity.

One photographic system would include a video camera using a high density pixel CCD (Charge Coupled Device) image converter, a flash unit, a frame "grabber" which is activated when the speeding vehicle reaches the exact position for the car and driver to be photographed, and a video recorder or frame memory which may be solid-state RAM (Random Access Memory) capable of recording an entire frame, for example, of 300,000 pixels. The date, time of day, license plate number and associated information are added to the recorded frame. The entire frame is then transmitted, over a telephone line, to police headquarters where it is recorded and printed out, for later use. For example, the photograph of the speeding car may be used, in some states, to issue a warning or traffic violation ticket and may be used, at trial, if the speeder challenges a ticket issued by a police officer. The inventor has conducted experiments using a Nikon F still camera and 1600 ASA color film and a HOYA 300 mm lens and also a SONY TR5 camcorder (NTSC-video 8) with SONY tape MP120 showing occupants in moving and non-moving vehicles. If the scene is correctly lighted, it is generally possible to recognize at least the gender, race and size of drivers. In those states in which a photograph of licensed drivers is maintained by the department of motor vehicles, the photograph of the speed limit violator may be matched, by human eye comparison, with the file photograph of the registered owner. If they match, a moving violation, a traffic ticket or warning may be issued.

The digital data stream from camera 10 is also transmitted to a license plate computer identifying system 40 which matches the license plate numbers of speeding vehicles with a list of registered vehicles. When a match is obtained, associated information, such as the make, model, year and registered owner of the vehicle is accessed. In one preferred embodiment the license number is matched with a list of license numbers, for example, all the license numbers of a state, in a large rapid access solid-state look-up table. In a preferred embodiment, the license data is stored and accessed according to the same techniques employed in the wanted car identification process described herein. Preferably, because of its lower cost, the look-up table is in hard disk (Winchester drive) whose access time is about 20 milliseconds. For example, the look-up table in main memory may be in a solid-state disk emulating data storage device such as Quantum "Hard Card" EZIDE memory having a capability of 240 MB and access time of under 70 nanoseconds. An alternative memory may be a series of 16 MB executed in MOSFET DRAM (Metal Oxide Semiconductor Field Effect Transistor-Dynamic Random Access Memory) or flash memory such as ACE Technologies "Double Flash 40 MB", i.e., non-volatile solid-state without a battery. Using an 6-bit byte for the license numbers and six significant numbers of letters (36 bits per license number) and a pointer of 6-bit bytes, the look-up table, with headers, of about 60 bits per entry would have about 3.4 million entries for each 244 MB memory in solid-state integrated circuit. However, such large-scale solid-state memory is presently rather expensive. For example, a 224MB "Dram Disk" from Curtis, St. Paul, Minn., is about 12 thousand dollars and has an access time of 0.1 ms, a block size of 512 bytes, and a battery back-up.

A suitable hard disk is the Seagate 1050 MB Model ST 41200N which operates at 15 milliseconds ("ms.") access time or the Micropolis 1354 MB Model HS-MC1528 which operates at 14 ms. access time. They may be updated electronically over a telephone line. An alternative auxiliary memory device would be a CD ROM (Compact Disk Read Only Memory), such as the Toshiba 600 MB, with 500 ms access time, which CD ROM may be physically changed on a regular basis, for example, monthly. Still another alternative would be a Bernoulli box or SONY magneto-optical disk. Standard data compression techniques could be used to increase the amount of license data stored.

A conventional hard disk of 200 MB (200×1,048,876) may have 1000 tracks. If the associated information is coded as to license number (six bytes); color, make, model and year (three bytes); and owner's last name (11 bytes), then the single 200 MB disk would have 10 million license plate number associated information and a 1000 MB hard disk stack would have over 100 million of such information.

Alternatively, particularly in the urban areas of large states, such as the New York City area and the Los Angeles area, the license plate number identifying system 40 may be at a central location to serve a number of camera systems at remote locations. In that type of network the license plate numbers, in a digital stream, is transmitted over a land line such as a dedicated telephone line (twisted wire pair, coaxial or fiber optic cable) to a central license plate number identifying computer, for example, at police headquarters or at a traffic management center. When the license plate of a speeding car is identified, the variable message warning sign (described below) may be operated by the central computer. Such a network presents a cost advantage since its central computer is used for a number of alphanumeric warning signs. In addition, the variable message signs may be jointly or separately controlled and used to warn drivers of road conditions.

The database of "wanted cars" and/or the database of license plate numbers and associated information may be stored in a mainframe computer. The mainframe computer will be located at police headquarters or at a Traffic Management Center (TMC). The disclosed system can tap into the database via a telephone line or through wireless communications means. The latter may include the use of a communications satellite in inner orbit. The satellite would pick up the electromagnetic waves from the transmitters, which are located at various points on the roadways, and re-direct the waves to the location of the database. The database would then be searched to determine if there are any license plate matches. If any matches are discovered, a transmitter would be used to contact a police car near the area where the wanted car was "picked up".

This satellite communication system, although not currently available, may be available in the future and may be useful in rural areas. Currently, several companies are experimenting or developing communications satellites which would circle the Earth in inner orbit. For example, Motorola recently signed a contract to develop such communications systems with McCaw Cellular, Inc. These satellites would be used for cellular communications, radio paging networks, and for other wireless communications systems.

The camera and data transmission system may also be utilized as part of a traffic surveillance system, since it may provide real time information on the speed and number of cars passing the camera. Such information may be communicated to the Traffic Management Center (TMC).

The computer identifying system 40 transmits via the CPU 31 selected associated information, in the form of digital data, to an alpha-numeric sign 50, preferably located above the roadway or on the side of the roadway. Such signs, sometimes called "variable message signs" or "writable highway signs", are presently used to warn of accidents and bad road conditions. They generally consist of an array of "pixel" elements such as a bank of incandescent bulbs or LEDs (Light Emitting Diodes) in rows and columns, for example, a large sign may have 2100 bulbs. The bulbs are lit, or not lit, to form numbers and alphabetical characters and are sometimes used as sports scoreboards and for advertising. Such variable alphanumeric message sign systems (VMS) are available, for example, from Fiberoptic Display Systems, Smithfield, R.I. 02917 (optical fibers forming light guides and rotational shutters); Skyline Products, Inc., Colorado Springs, Colo. 80910; AGS, South Hadley, Mass. 01075; and Daktronics, Inc., Brookings, S.D. (glow tubes). Alternatively, other types of alpha-numerical signs may be used, such as those described in U.S. Pat. Nos. 4,724,629; 4,833,806; 5,050,325 and 5,184,116.

Figure 6:
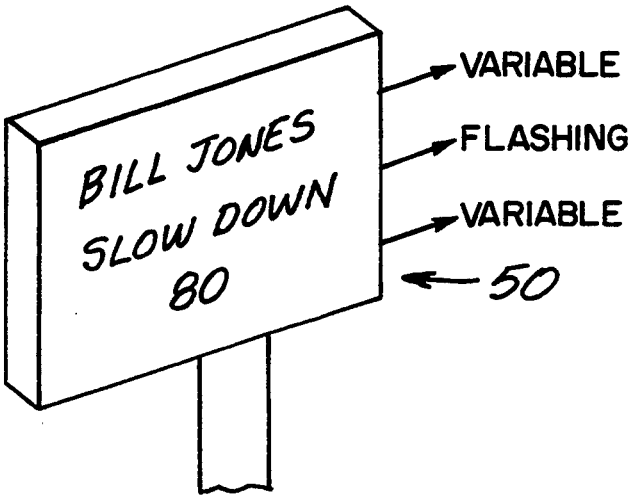
FIG. 6 is a perspective view of an alternative variable message sign having fewer alterable characters.

The sign 50 acts as a warning device and preferably displays the speeding vehicle's license number, owner and its speed. For example, the sign may say "LNV 195—Jones—88 MPH" along with a message such as "please slow down" or "this is a warning". Preferably only the registered owner's last name is displayed, but alternatively the registered owner's first and last names may be displayed. A less expensive sign is shown in FIG. 6, in which the only variable characters are those displaying speed and the vehicle owner's name. The other warnings (messages) are fixed and are simply flashed on when the sign is operated. Such a sign, it is estimated, may cost in the 10–20 thousand dollar range.

There is no requirement that the system be very accurate. If it fails to detect and identify every speeding vehicle, it would at least be effective as to those vehicles it does identify. If the identification is incorrect, it is most likely to be a harmless error, since the warning would be given to a vehicle which is not in the vicinity of the sign.

Those drivers who see the warning sign are likely to slow down. They would know, after time, that their vehicle speed and identification is being recorded and the police notified. Preferably the system would be advertised and explained to the public. The public would recognize that if their name is on the display sign it means (i) they are speeding; (ii) their name, speed, license plate, date and time are being recorded; and (iii) a description of their speeding car (license plate number, car type and year) is being broadcast to police officers waiting further along the highway.

The patents mentioned above are incorporated by reference herein, namely, U.S. Pat. Nos. 4,234,923; 4,866,438; 5,066,950; 5,175,617; 5,204,573; and 5,231,393.

What is claimed is:

1. A method in traffic control for the detection and identification of moving vehicles on a roadway whose vehicle speed exceeds a predetermined speed limit, the method including:

(a) measuring the speed of the vehicles and determining if any of the vehicles are speeding vehicles because their speed exceeds the predetermined speed limit;

(b) automatically reading the license plate number of the speeding vehicles using an opto-electric reader which converts license plate alpha-numerics into digital signals;

(c) automatically, in a computer system, matching the license plate digital signals with a database of vehicle license numbers and deriving associated information therefrom associated with the matched license plate digital signals, including the name of the speeding vehicle's registered owner; and (d) displaying the name of the speeding vehicle's registered owner to the speeding vehicles.

2. A method as in claim 1 and further including displaying the speed of the speeding vehicles to the speeding vehicles.

3. A method as in claim 1 wherein the associated information displayed to the speeding vehicles includes the first and last names of the vehicle's registered owner.

4. A method as in claim 1 wherein the speed of the vehicles is measured by a Doppler radar system.

5. A method as in claim 1 wherein the speed of the vehicles is measured by two parallel infrared beams.

6. A method as in claim 1 wherein in (b) the license plate is read by a space-variant sensor which produces a logmap.

7. A method as in claim 1 wherein in (c) the license plate number is compared with a database in a look-up table in solid-state memory and the look-up table points to a location in disk memory to retrieve the associated information.

8. A method as in claim 1 wherein the display is on an alphanumeric variable message sign proximate the roadway.

9. A method as in claim 8 wherein the sign is on a side of the roadway.

10. A method as in claim 1 and further including transmitting the license plate number and at least some of the associated information regarding speeding vehicles to a police officer.

11. A method as in claim 10 wherein the transmission is a voice transmission by radio.

12. A method as in claim 1 and further including automatically reading and matching the license plate numbers of vehicles with a database of wanted vehicles, said wanted vehicle database including a list of vehicles which have been stolen, the wanted vehicle database including information identifying the wanted vehicles, and transmitting the license plate number and identifying information to a police officer.

13. A method as in claim 1 and further including displaying the license plate numbers of (b) to speeding vehicles.

14. A method as in claim 13 and further including displaying the speed of each speeding vehicle of (a) to that speeding vehicle.

15. A traffic control system for the detection and identification of moving vehicles on a roadway whose vehicle speed exceeds a predetermined speed limit, the system including:

(a) means to measure the speed of the vehicles and determine if any of the vehicles are speeding vehicles because their speed exceeds the predetermined speed limit;

(b) an opto-electric reader means for automatically reading the license plate number of the speeding vehicles and converting license plate number alpha-numerics into digital signals;

(c) a computer database of license plate numbers and associated information associated with each license plate number, the associated information including the names of the registered owners;

(d) computer means for matching the license plate digital signals and the computer database of vehicle license numbers and deriving therefrom the associated information;

(e) display means for displaying the names of the registered owners of speeding vehicles to the speeding vehicles.

16. A system as in claim 15 and further including display means for displaying the speed of the speeding vehicles to the speeding vehicles.

17. A system as in claim 15 wherein the associated information displayed to the speeding vehicles includes the first and last names of the vehicle's owner.

18. A system as in claim 15 wherein the means to measure the speed of the vehicles is a Doppler radar system.

19. A system as in claim 15 wherein the means to measure the speed of the vehicles comprises two parallel infrared beams.

20. A system as in claim 15 wherein in (b) the opto-electric reader is a space-variant sensor producing a logmap.

21. A system as in claim 15 wherein in (c) the computer means includes a database of license plate numbers in a look-up table in solid-state memory and a disk memory and the look-up table points to a location in the disk memory to retrieve the associated information in less than one second after the license plate number is read.

22. A system as in claim 15 wherein the display is an alphanumeric variable message sign proximate the roadway.

23. A system as in claim 22 wherein the sign is on a side of the roadway.

24. A system as in claim 15 and further including broadcast means for transmitting the license plate number and at least some of the associated information regarding speeding vehicles to a police officer.

25. A system as in claim 24 wherein the broadcast means includes a digital data to voice synthesizer and a local area radio broadcast system.

26. A system as in claim 15 and further including means for automatically reading and matching the license plate numbers of vehicles with a database of wanted vehicles, said wanted vehicle database including a list of vehicles which have been stolen, the wanted vehicle database including information identifying the wanted vehicles, and means for transmitting the license plate number and identifying information to a police officer.

* * * * *